US010421204B2

(12) United States Patent
Griffin et al.

(10) Patent No.: US 10,421,204 B2
(45) Date of Patent: Sep. 24, 2019

(54) RAZOR CARTRIDGES

(71) Applicant: DORCO COMPANY LTD., Seoul (KR)

(72) Inventors: John W. Griffin, Moultonborough, NH (US); Craig A. Provost, Providence, RI (US); William E. Tucker, Attleboro, MA (US); Douglas R. Kohring, Saco, ME (US)

(73) Assignee: DORCO CO., LTD., Seoul (KR)

( * ) Notice: Subject to any disclaimer, the term of this patent is extended or adjusted under 35 U.S.C. 154(b) by 593 days.

(21) Appl. No.: 14/494,424

(22) Filed: Sep. 23, 2014

(65) Prior Publication Data

US 2015/0090085 A1 Apr. 2, 2015

Related U.S. Application Data

(60) Provisional application No. 61/885,906, filed on Oct. 2, 2013.

(51) Int. Cl.
*B26B 21/40* (2006.01)
*B26B 21/22* (2006.01)

(52) U.S. Cl.
CPC ..... *B26B 21/4018* (2013.01); *B26B 21/222* (2013.01); *B26B 21/4068* (2013.01);
(Continued)

(58) Field of Classification Search
CPC ..... B26B 21/4068; B26B 21/4075; B26B 21/4018
(Continued)

(56) References Cited

U.S. PATENT DOCUMENTS 1,299,096 A 4/1919 Ames
1,299,097 A 4/1919 Ames
(Continued)

FOREIGN PATENT DOCUMENTS

DE 102009050344 5/2011
FR 2660589 10/1991
(Continued)

OTHER PUBLICATIONS

International Search Report—Corresponding PCT Application No. PCT/US2014/057048, dated Jan. 9, 2015, 4 pages.
(Continued)

*Primary Examiner* — Kenneth E Peterson
(74) *Attorney, Agent, or Firm* — Lee, Hong, Degerman, Kang & Waimey PC

(57) ABSTRACT

Replaceable shaving assemblies are disclosed that include a razor cartridge comprising: an elongated housing defining a central open area, and, adjacent each short edge of the housing, a clip-receiving aperture and a clip-receiving channel; a plurality of blades disposed within the open area of the housing, and a pair of clips, each clip having a first leg and a second leg, the first leg extending through the clip-receiving aperture and being bent against a lower surface of the housing, and the second leg being wrapped around the housing and seated in the clip-receiving channel. Shaving systems including such shaving assemblies are also disclosed, as are methods of using such shaving systems and methods of manufacturing these cartridges.

13 Claims, 10 Drawing Sheets

(52) U.S. Cl.
CPC ..... *B26B 21/4075* (2013.01); *Y10T 29/49908* (2015.01); *Y10T 83/04* (2015.04)

(58) Field of Classification Search
USPC ..... 30/50
See application file for complete search history.

(56) References Cited

U.S. PATENT DOCUMENTS

| | | | | |
|---|---|---|---|---|
| 3,031,757 | A | 5/1962 | Kramer | |
| 3,067,513 | A | 12/1962 | Randol | |
| 4,270,268 | A | 6/1981 | Jacobson | |
| 5,224,267 | A * | 7/1993 | Simms | B26B 21/4068 30/50 |
| 5,369,885 | A | 12/1994 | Ferraro | |
| 5,687,485 | A | 11/1997 | Shurtleff et al. | |
| 5,761,814 | A * | 6/1998 | Anderson | B26B 21/227 30/50 |
| 5,848,475 | A | 12/1998 | Hill et al. | |
| 5,956,848 | A | 9/1999 | Tseng et al. | |
| 5,956,851 | A | 9/1999 | Kpprille et al. | |
| 6,035,535 | A | 3/2000 | Dischler | |
| 6,035,537 | A | 3/2000 | Apprille, Jr. et al. | |
| 6,041,926 | A | 3/2000 | Petricca et al. | |
| 6,052,903 | A | 4/2000 | Metcalf et al. | |
| 6,185,822 | B1 | 2/2001 | Tseng et al. | |
| 6,212,777 | B1 | 4/2001 | Gilder et al. | |
| 6,237,232 | B1 | 5/2001 | Petricca et al. | |
| 6,442,839 | B1 | 9/2002 | Tseng et al. | |
| 6,516,518 | B1 | 2/2003 | Garraway et al. | |
| 6,612,040 | B2 | 9/2003 | Gilder | |
| 6,684,513 | B1 | 2/2004 | Clipstone et al. | |
| 6,886,262 | B2 | 5/2005 | Ohtsubo et al. | |
| 7,197,825 | B2 * | 4/2007 | Walker | B26B 21/225 30/34.2 |
| 7,275,461 | B2 | 10/2007 | Gherman et al. | |
| 7,681,320 | B2 * | 3/2010 | Szczepanowski | B26B 21/225 30/34.05 |
| 8,286,354 | B2 | 10/2012 | Walker, Jr. | |
| 8,789,282 | B2 | 7/2014 | Wilson et al. | |
| 2003/0204915 | A1 | 11/2003 | Colemen, Jr. | |
| 2010/0083505 | A1 | 4/2010 | Royle et al. | |
| 2010/0139103 | A1 | 6/2010 | Miyazaki | |
| 2011/0232101 | A1 | 9/2011 | Park et al. | |
| 2011/0258856 | A1 | 10/2011 | Walker et al. | |
| 2013/0312265 | A1 | 11/2013 | Wilson et al. | |
| 2015/0082638 | A1 | 3/2015 | Georgakis | |
| 2015/0174775 | A1 | 6/2015 | Hodgson | |
| 2015/0174776 | A1 | 6/2015 | Hawes | |
| 2016/0354940 | A1 | 12/2016 | Bozikis et al. | |
| 2017/0203451 | A1 | 7/2017 | Griffin et al. | |
| 2017/0217033 | A1 | 8/2017 | Tucker et al. | |

FOREIGN PATENT DOCUMENTS

| | | | |
|---|---|---|---|
| WO | 9610473 | | 4/1996 |
| WO | 9717174 | | 5/1997 |
| WO | 9955499 | | 11/1999 |
| WO | 2012158142 | | 11/2012 |
| WO | 2016/007329 | A1 | 1/2014 |
| WO | 2015/127978 | A1 | 9/2015 |
| WO | 2016/028550 | A1 | 2/2016 |

OTHER PUBLICATIONS

Extended European search report with supplementary European search report and the European search opinion issued by the European Patent Office for corresponding European Patent Application No. 14851150.4, dated Nov. 20, 2017.

* cited by examiner

RAZOR CARTRIDGES

RELATED APPLICATIONS

This application claims the benefit of U.S. Provisional Application Ser. No. 61/885,906, filed Oct. 2, 2013. The complete disclosure of this application is hereby incorporated by reference herein.

BACKGROUND

Shaving systems often consist of a handle and a cartridge in which one or more blades are mounted in a plastic housing. In some cases, the cartridge comprises metallic clip elements. These clips can serve a number of purposes. Primarily the blades are held in place in the housing by a pair of clips, mounted at opposite ends of the length of the blades. The clips can also define the blade exposure. Furthermore, since these clips can be made from different materials than the blades, they can be fabricated from aluminum or any other sacrificial electrochemical element or alloy that will prevent the blades from corroding. Examples of typical clip configurations can be found, for example, in U.S. Pat. Nos. 5,761,814, 6,035,537, 6,044,542, 8,286,354, and 7,966,731, the full disclosures of which are hereby incorporated by reference herein. Each of these clips may be wrapped around the outer surface of the housing, or secured in place by being inserted through two holes in the housing in the manner of a staple. In both cases, the legs of the clips that extend below the housing are bent around the housing, again in a staple-like shape.

SUMMARY

In general, the present disclosure pertains to razor cartridges (also known as blade units), and to shaving systems and replaceable shaving assemblies that include such cartridges.

In one aspect, the invention features a razor cartridge comprising (a) an elongated housing defining a central open area, and, adjacent each short edge of the housing, a clip-receiving aperture and a clip-receiving channel, (b) a plurality of blades disposed within the open area of the housing, and (c) a pair of clips, each clip having a first leg and a second leg, the first leg extending through the clip-receiving aperture and being bent against a lower surface of the housing, and the second leg being wrapped around the housing and seated in the clip-receiving channel.

Some implementations include one or more of the following features.

Each clip-receiving channel may have an upper radiused surface. Each clip-receiving channel may have a bottom surface that is recessed to accommodate the thickness of the clip, typically at least 0.05 mm below an adjacent horizontal surface of the housing. The clip-receiving channel may define a bottom surface, the profile of which is generally C-shaped.

In some cases, the housing further comprises a plurality of blade positioning elements, extending upwardly from a floor of the housing in the central open area, on which the blades are seated. At least some of the blade positioning elements may be disposed between the clip-receiving aperture and the clip-receiving channel on each side of the housing. The blades may be fixed blades. The open area of the housing may extend between the clip-receiving aperture and the clip-receiving channel on each side of the housing.

The cartridge may further comprise a cap extending along one edge of the housing and a guard extending along the opposite long edge. In such cartridges the clip-receiving apertures may be disposed adjacent to ends of the guard and the clip-receiving channels may be disposed adjacent to ends of the cap. A flat upper portion of each clip may extend beyond the blade closest to the cap a distance substantially equal to the width of the cap, supported by an underlying portion of the housing. The housing may further comprise a guard bar, and an edge of the clip-receiving aperture about which the clip is bent may be substantially collinear with the long axis of the guard bar.

In another aspect, the invention features a shaving system that includes (a) a handle having a distal end and a proximal end; and (b) a replaceable shaving assembly, mounted on the distal end of the handle, the shaving assembly including a razor cartridge. The razor cartridge comprises (i) an elongated housing defining a central open area, and, adjacent each short edge of the housing, a clip-receiving aperture and a clip-receiving channel, (ii) a plurality of blades disposed within the open area of the housing, and (iii) a pair of clips, each clip having a first leg and a second leg, the first leg extending through the clip-receiving aperture and being bent against a lower surface of the housing, and the second leg being wrapped around the housing and seated in the clip-receiving channel.

Some implementations of this aspect of the invention may include any one or more of the features discussed above or elsewhere herein.

In other aspects, the invention features methods of contacting the skin with the razor cartridges described herein, and methods of manufacturing razor cartridges.

DETAILED DESCRIPTION

Figure 1:
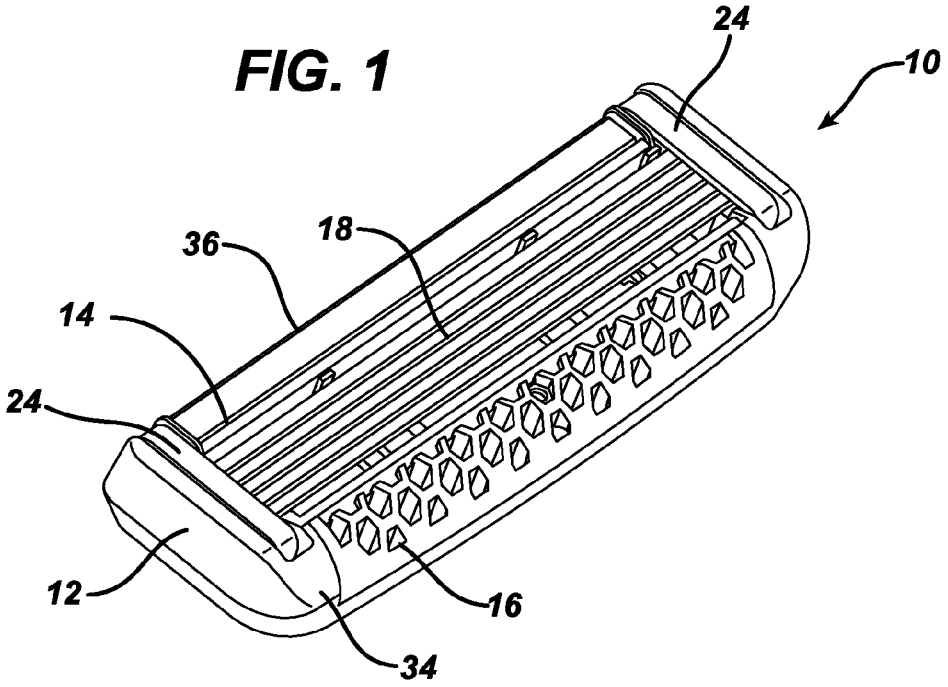
FIGS. 1-1A are perspective views of a razor cartridge according to one implementation, with the razor cartridge in different rotational positions.
Figure 1A:
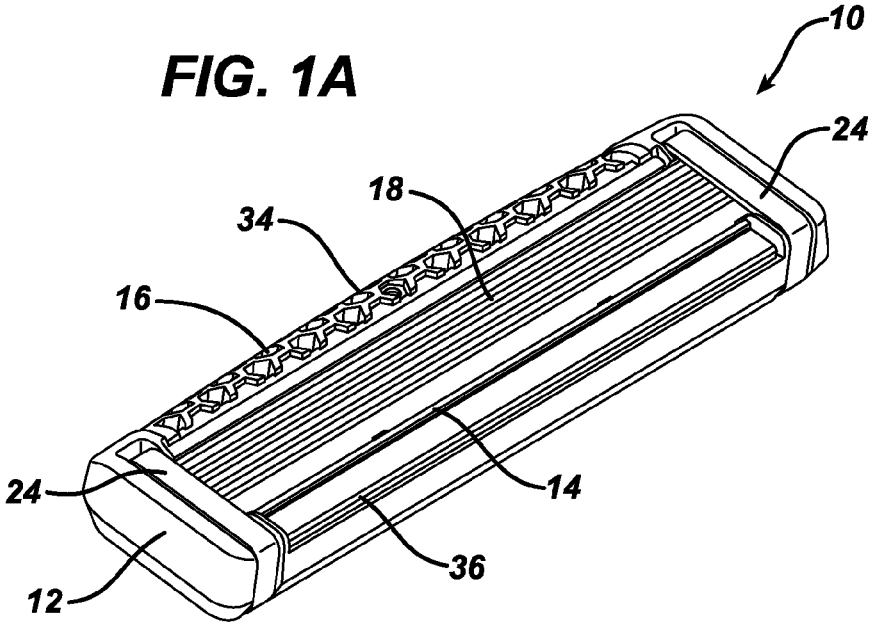
Figure 1B:
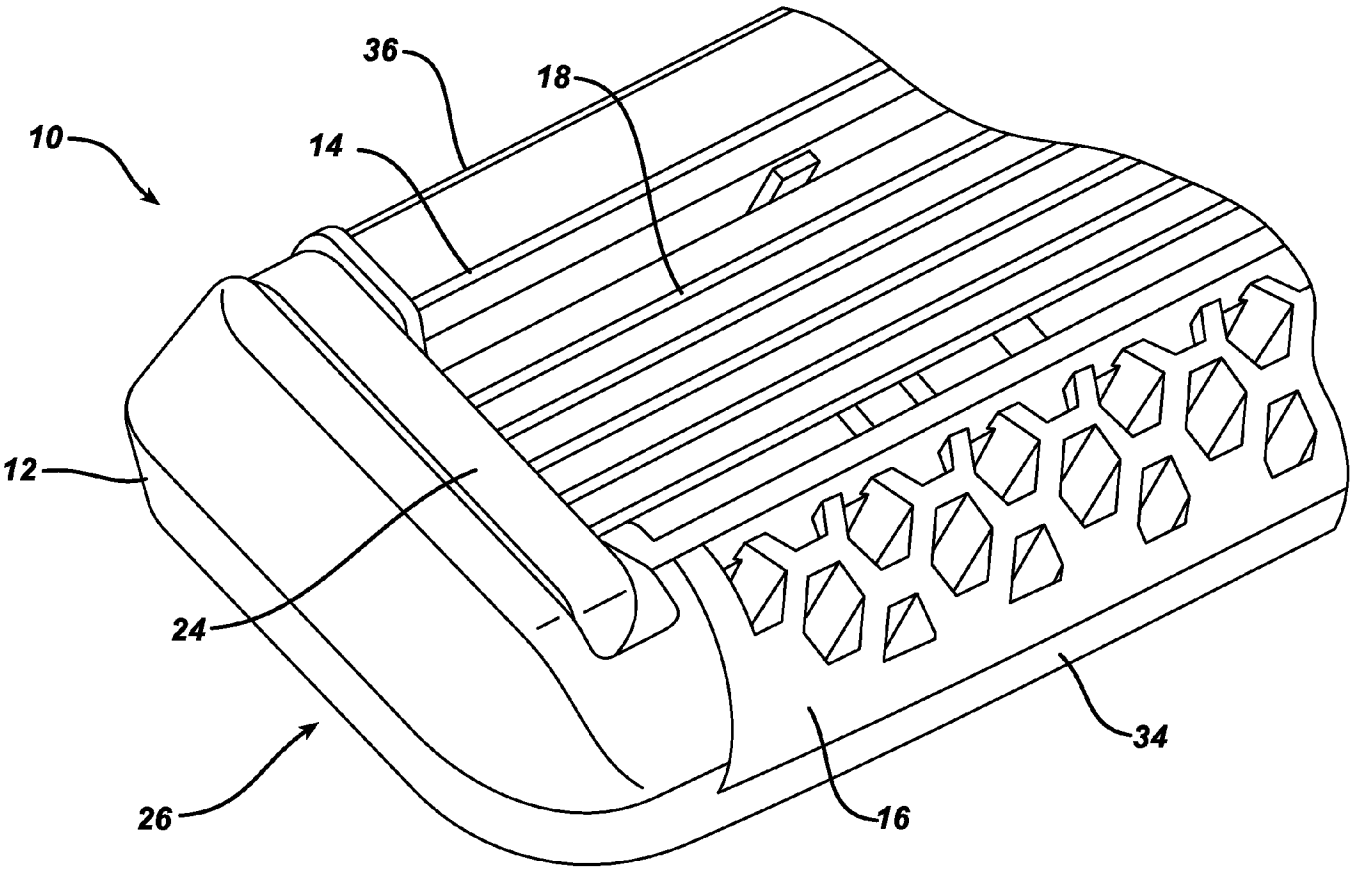
FIGS. 1B-1C are enlarged perspective views.
Figure 1C:
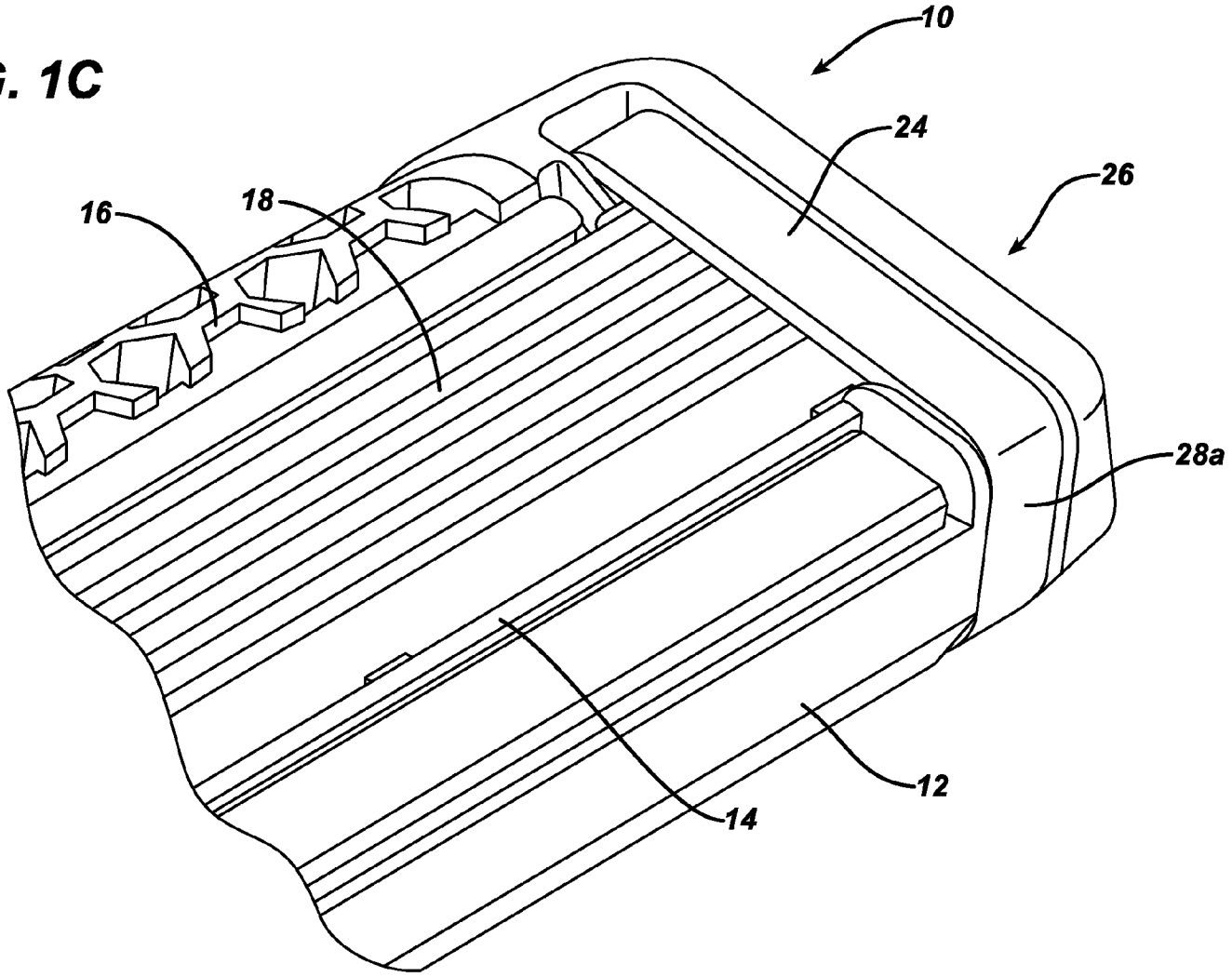
Figure 1D:
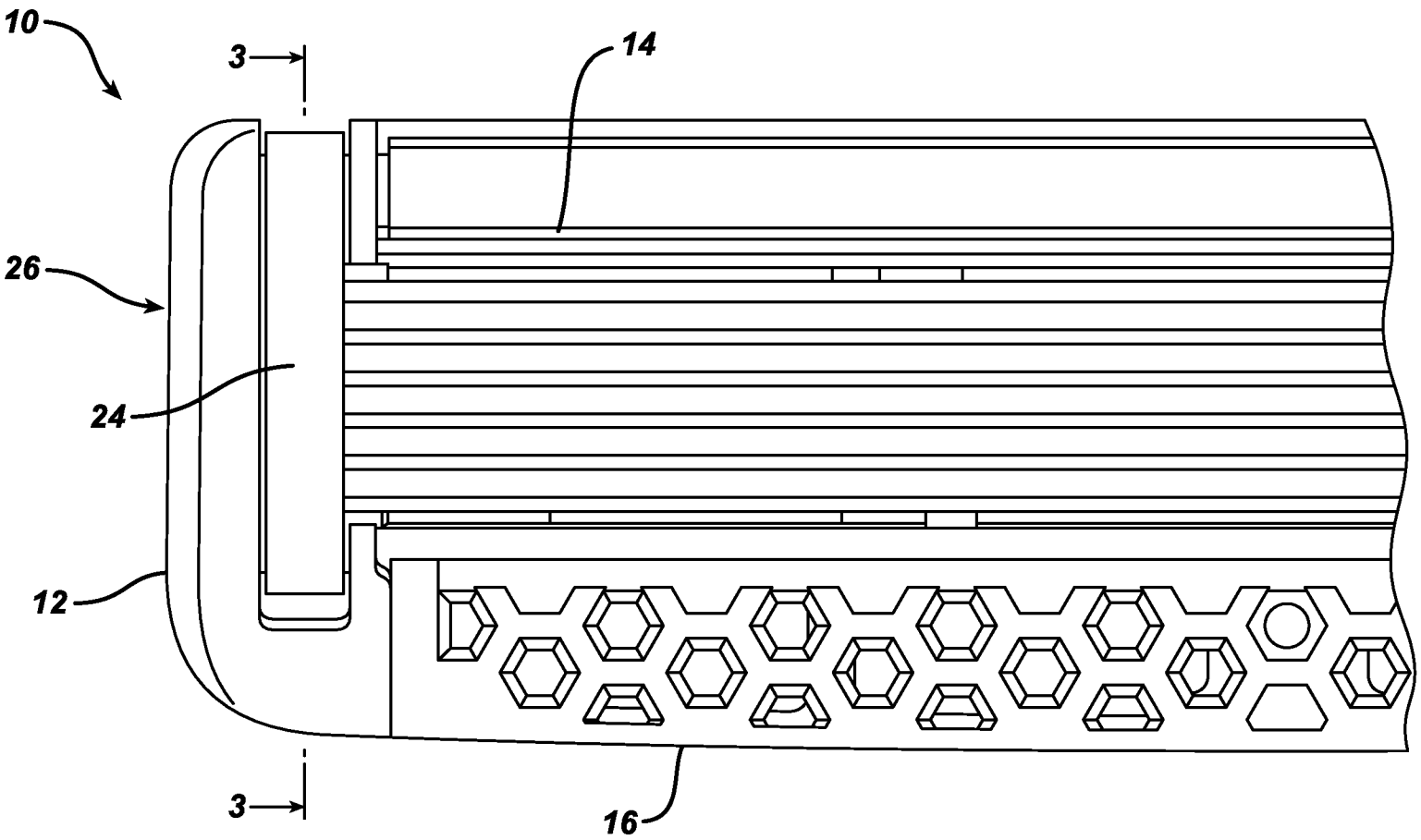
FIG. 1D is an enlarged top view, of a portion of the razor cartridge.
Figure 2:
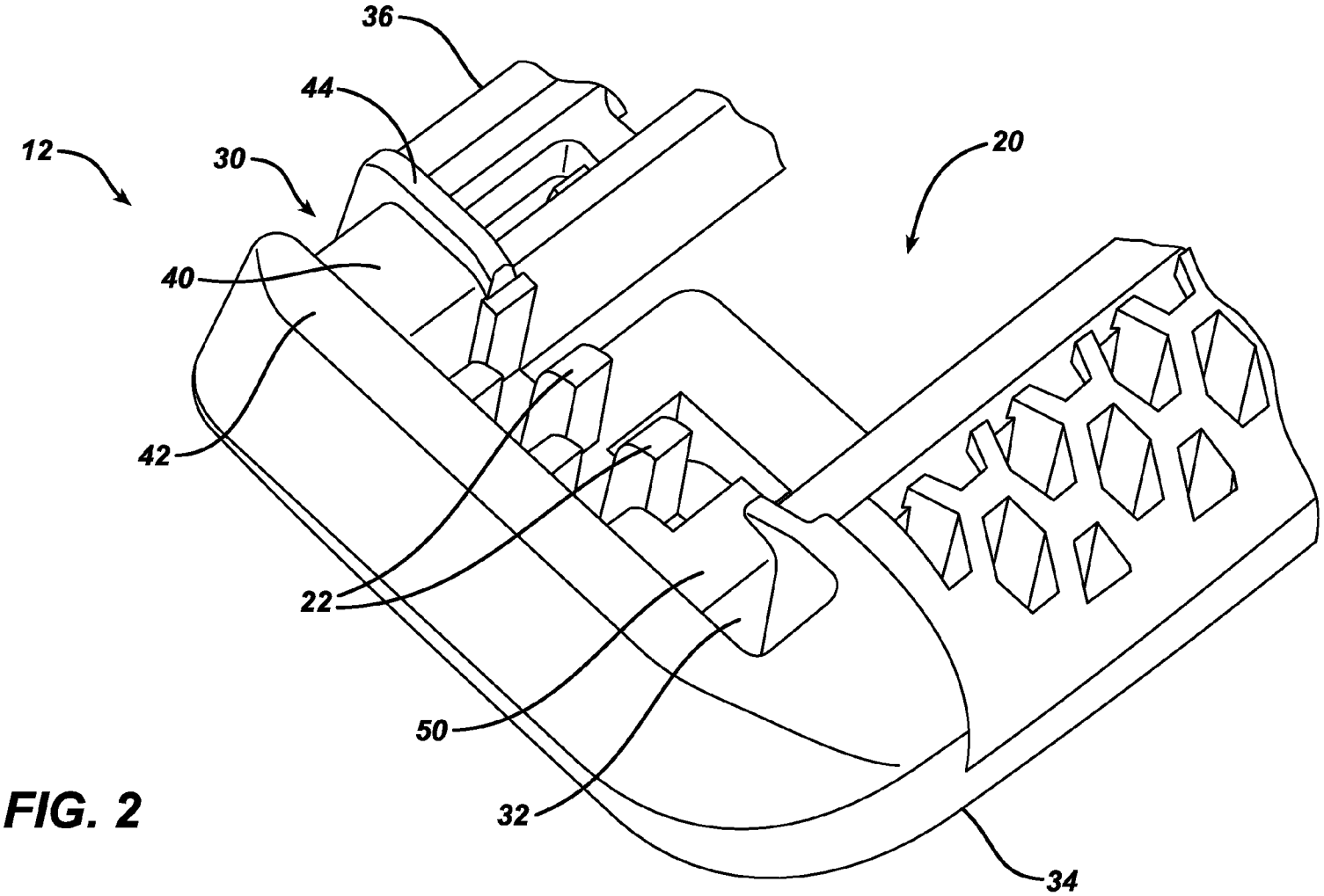
FIGS. 2 and 2A are perspective views.
Figure 2A:
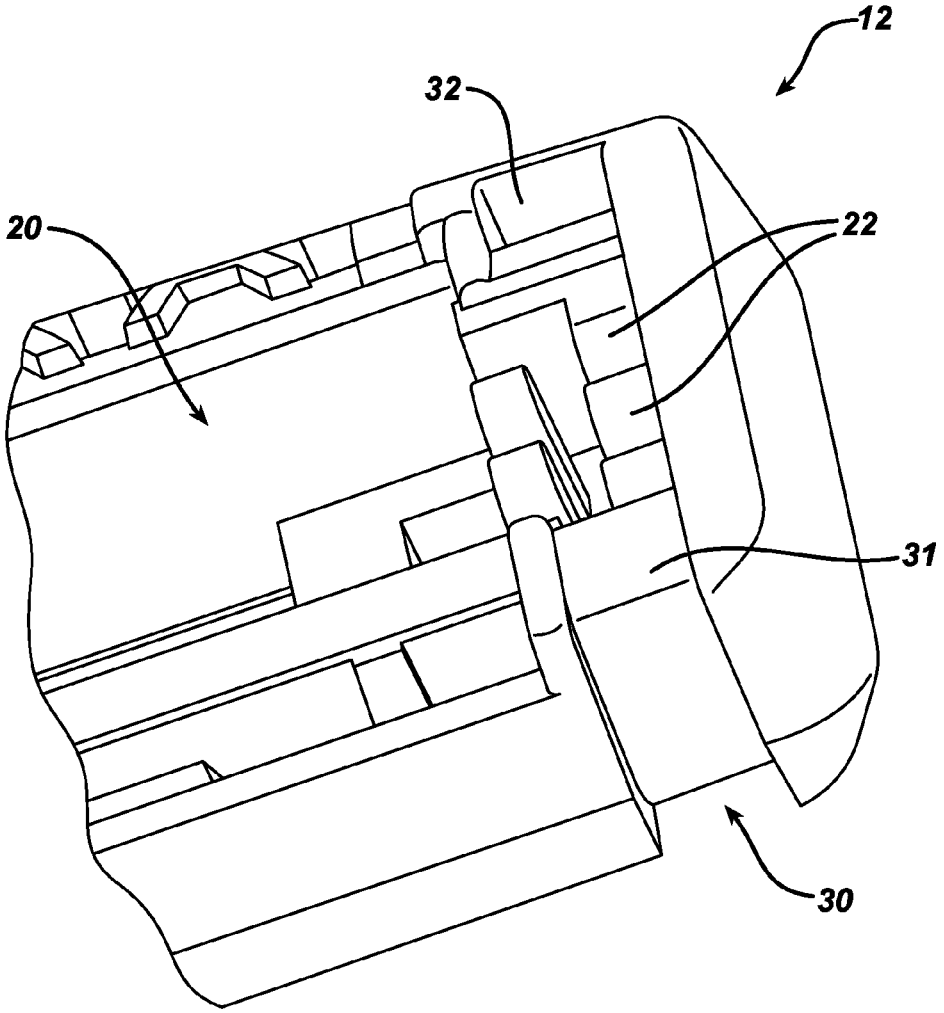
Figure 2B:
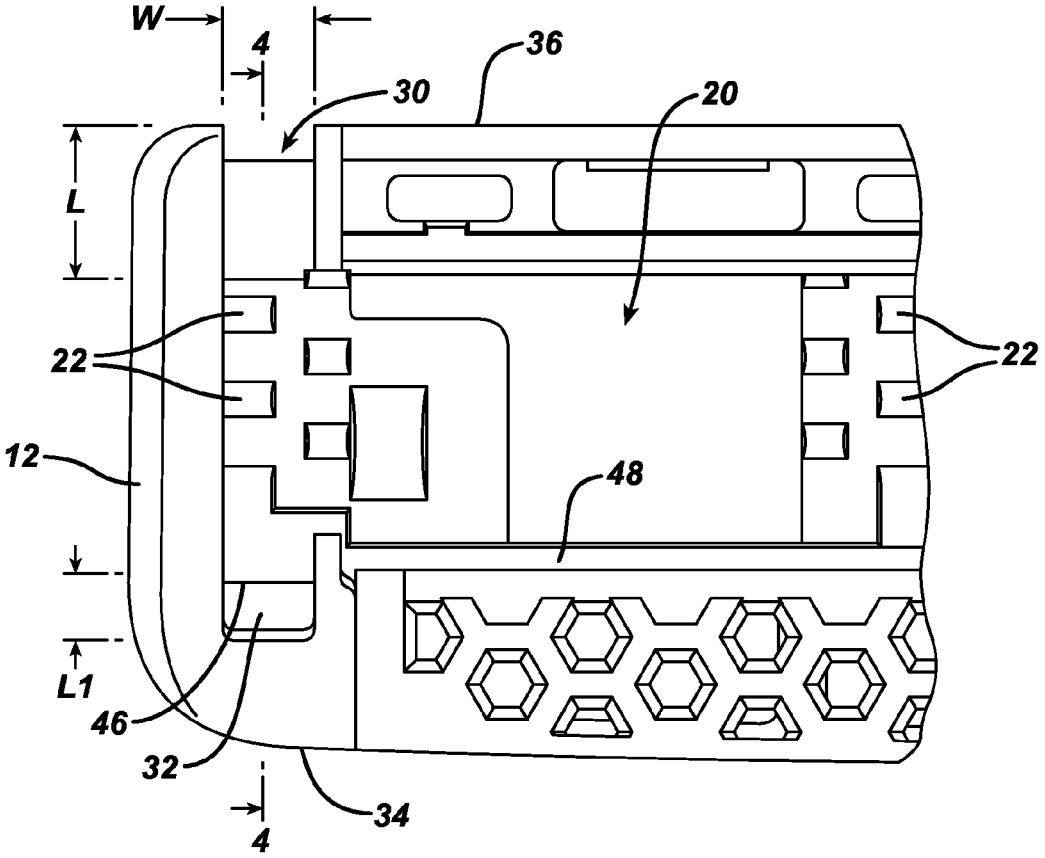
FIG. 2B is a top view, of a portion of the housing of the razor cartridge shown in FIG. 1.
Figure 3:
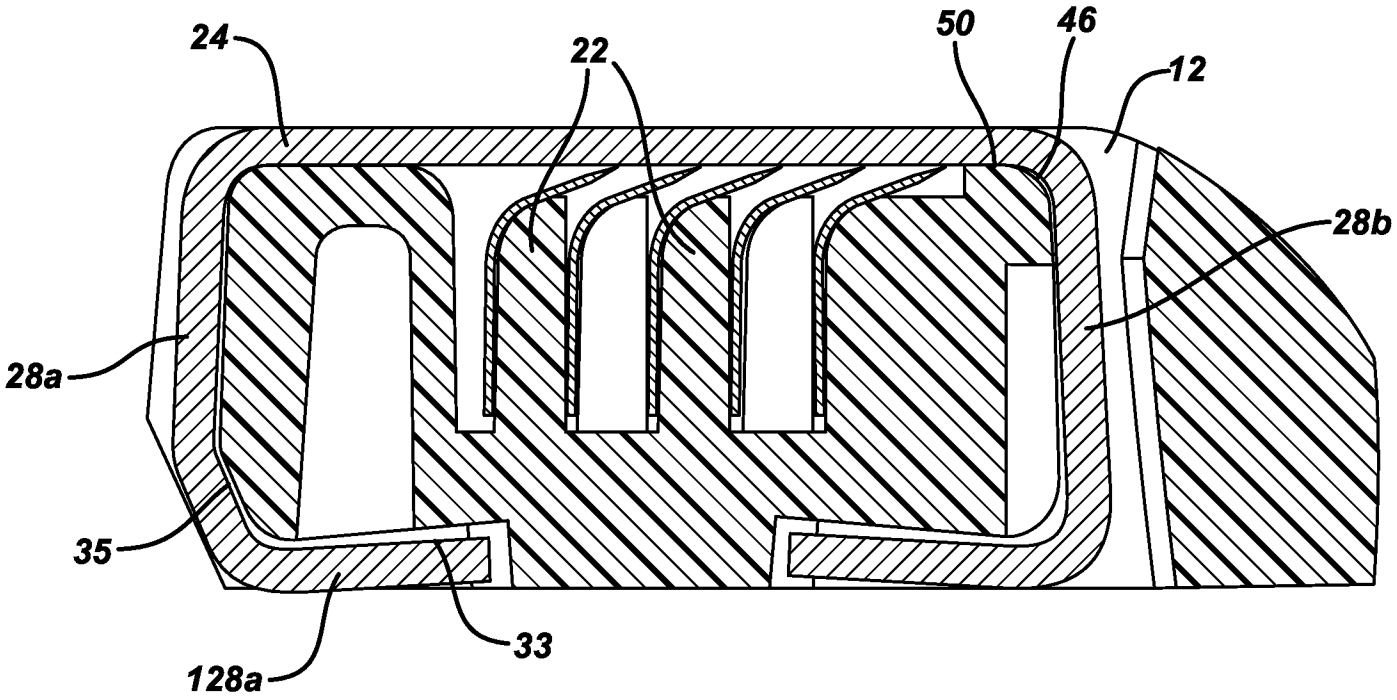
FIG. 3 is a cross-sectional view of the cartridge, taken along line 3-3 in FIG. 1D.
Figure 4:
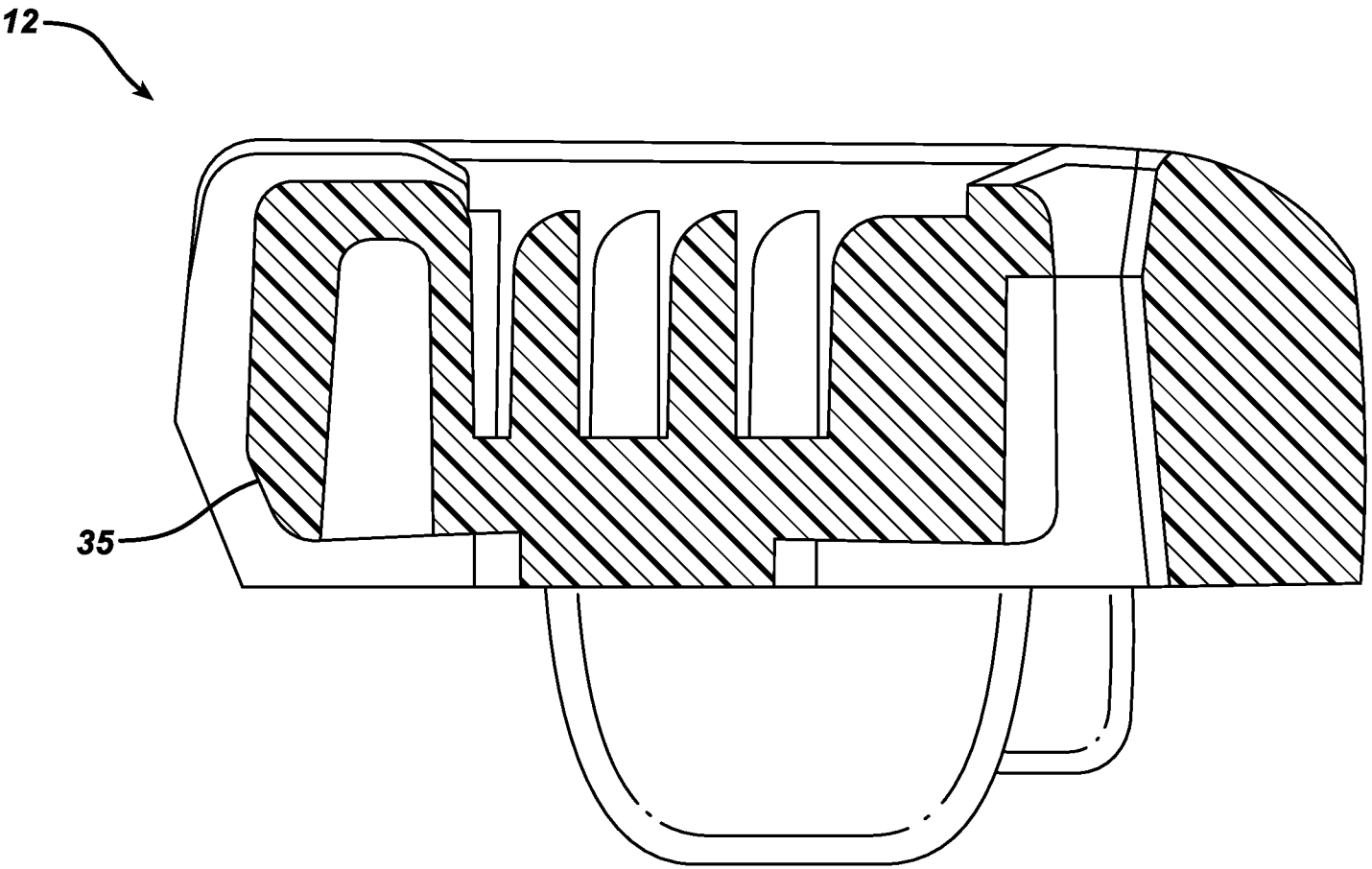
FIG. 4 is a cross-sectional view of the housing, taken along line 4-4 in FIG. 2B.

FIGS. 1-1C show a razor cartridge 10 that includes a housing 12, a cap 14, a guard 16, and a plurality of blades 18 disposed between the cap and guard. Blades 18 are disposed in a central open area 20 of the housing, shown in FIG. 2B, and are positioned by alternating blade positioning elements 22 (FIG. 2, FIG. 3). The alternating arrangement of the blade positioning elements 22 (seen best in FIG. 2) defines a plurality of slots which hold the blades in predefined positions relative to each other, while the curved upper surface of the positioning elements 22 support the lower surfaces of the upper portions of the blades to maintain the blades in a predefined shaving geometry. The clips 24 secure the blades against the positioning elements, maintaining the shaving geometry during shaving. The blades are preferably fixed blades, i.e., they are positioned by the positioning elements 22 in a manner that does not permit deflection of the blades during shaving.

Figure 5:
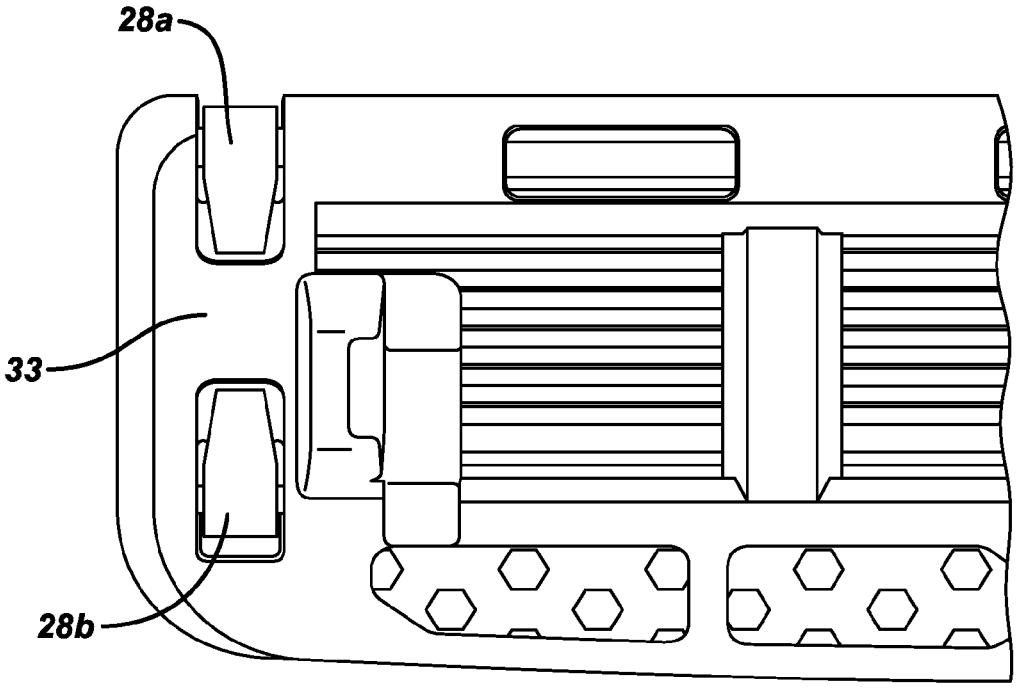
FIG. 5 is a bottom view of the razor cartridge shown in FIG. 1.

A pair of clips 24, disposed just inboard of the short ends 26 of the housing 12, maintain the blades in the desired blade geometry and retain the blades securely in the housing. As shown in FIG. 3, each clip has a pair of legs 28*a*, 28*b*. Referring to FIGS. 2B and 3, leg 28*a* wraps around an open clip-receiving channel 30 that is provided in the corners of the housing 12 that are adjacent the ends of the cap 14. Leg 28*b* extends through a closed clip-receiving aperture 32 provided in the corners of the housing that are adjacent the ends of the guard. The distal ends of the legs are bent around the lower (back) surface 33 of the cartridge, toward each other, as shown in FIGS. 3 and 5. Leg 28A is bent around angled surface 35 (FIG. 3) in a double bend configuration such that portion 128*a* of leg 28*a* is at a negative angle with respect to the blade plane. This double bend helps to hold the outboard leg 28*a* securely against the housing during shaving.

Due to this aperture/channel arrangement, leg 28*b* is inboard of the leading edge 34 of the cartridge, while leg 28*a* is outboard and its surface is exposed and only slightly recessed relative to the trailing edge 36 of the cartridge. The inboard configuration of leg 28*b* provides a secure attachment of the clip to the housing and facilitates proper location of the clip during assembly of the cartridge. The outboard configuration of leg 28*a* allows the flat upper portion of the clip to extend well past the last blade on the cap side of the cartridge, supported by the housing as shown in FIG. 3. This clip geometry may help the clip to apply the force needed to maintain the predefined blade geometry over time. Wrapping leg 28*a* around the outer surface of the housing may also simplify assembly relative to a configuration in which both legs of the clip are inserted into closed apertures in the housing.

Referring to FIG. 2, in preferred embodiments the bottom surface 40 of clip-retaining channel 30 has a depth, relative to the adjacent top surfaces 42 and 44 of the housing, which is sufficient to help align the clip on the housing during assembly and to retain the clip in place during shaving. Thus, the depth of the channel will be determined by the thickness of the clip material, with the channel preferably being sufficiently deep that the clip will be recessed below or flush with the adjacent top surface 42. In some cases, the channel has a depth of at least 0.05 mm, e.g., from about 0.05 to 1.0 mm. For example, if the clip has a thickness of about 0.4 mm the channel may have a depth of from about 0.4 to 0.6 mm.

The width W (FIG. 2B) of the clip-retaining channel is sufficient to allow easy insertion of the clip into the channel during assembly, while being small enough to prevent excessive lateral movement of the clip and ensure proper clip orientation. For example, in some cases the width of the channel may be less than 1 mm or even less than 0.5 mm greater than the width of the clip.

The length L (FIG. 2B) of the channel as it extends from the trailing edge 36 of the housing toward the leading edge is sufficient to support the clip. In some cases, the channel extends from the trailing edge 36 to the leading edge of the cap, as shown, or in some cases (depending on blade spacing) may extend further. Preferably, the channel 30 has a radiused upper edge 31 (FIG. 2A), preventing contact of the clip with a sharp edge of the plastic housing.

Referring to FIG. 2B, the clip-retaining aperture 32 preferably has a width that is substantially equal to that of the channel 30. The length L1 of the aperture is sufficiently large to allow easy insertion of the clip. The inner edge 46 of the aperture is preferably substantially collinear with the leading edge of a guard bar 48 of the housing, as shown. Referring to FIG. 3, this causes the flat upper portion of the clip to terminate just beyond the edge of the leading blade, which may provide an advantageous distribution of the downward force provided by the clip, further enhancing stability of the blade geometry.

Referring to FIGS. 2 and 3, a support surface 50, the height of which is substantially equal to that of bottom surface 40 (FIG. 2) of the channel 30, is provided inboard of the aperture 32. As shown in FIG. 3, this support surface 50, together with bottom surface 40, supports the flat, upper portion of the clip and distributes the force provided by the clip over the length of this upper portion.

The housing 12 can be made of any suitable material including, for example, acrylonitrile butadiene styrene (ABS), polystyrene, polyethylene terephthalate (PET or PETE), high density (HD) PETE, thermoplastic polymer, polypropylene, oriented polypropylene, polyurethane, polyvinyl chloride (PVC), polytetrafluoroethylene (PTFE), polyester, high-gloss polyester, nylon, or any combination thereof.

The clips can be made of metals (preferably Aluminum, aluminum alloys) or other malleable material.

The cap, and guard may be made of any suitable materials, as is well known in the shaving art, e.g., as described in the patents that incorporated by reference above.

A number of embodiments have been described. Nevertheless, it will be understood that various modifications may be made without departing from the spirit and scope of the disclosure.

For example, while in the embodiment shown the clip-receiving channels are adjacent the ends of the cap and the clip-receiving apertures are adjacent the ends of the guard, this configuration may be reversed, such that the channels are adjacent the cap ends and the apertures are adjacent the guard ends.

Accordingly, other embodiments are within the scope of the following claims.

What is claimed is:

1. A razor cartridge comprising:

an elongated housing defining a central open area, and, adjacent each short edge of the housing, a clip-receiving aperture, and a clip-receiving channel, a plurality of blades disposed within the open area of the housing, and a pair of clips, each clip having a first leg and a second leg, the first leg extending through the clip-receiving aperture and being bent against a lower surface of the housing, and the second leg wrapped around a channel support member of the housing and seated in the clip-receiving channel, wherein the plurality of blades are supported by positioning elements arranged on both lateral sides of the housing and configured to secure positioning of the blades, wherein the channel support member is shaped to define an opening at a lower side of the housing, and wherein the opening is spanned by a portion of the second leg to define an elongated empty space within the opening which extends upward along a height of the channel support member, wherein a profile of the channel support member is formed in a C-shape and the opening corresponds to an open side of the C-shape, and wherein the channel support member comprises a first surface and a second surface angled with respect to the first surface at the clip receiving channel, wherein the second surface is adjacent to a lower corner of the channel support member which is adjacent to the opening such that the second leg is bent around the first surface, the second surface, and the lower corner in a double-bend configuration adjacent to the opening.

2. The razor cartridge of claim 1, wherein each clip-receiving channel has an upper radiused surface.

3. The razor cartridge of claim 1, wherein each clip-receiving channel has a bottom surface that is recessed at least 0.05 mm below an adjacent horizontal surface of the housing.

4. The razor cartridge of claim 1, wherein the housing further comprises a plurality of blade positioning elements, extending upwardly from a floor of the housing in the central open area.

5. The razor cartridge of claim 4, wherein at least some of said blade positioning elements are disposed between the clip-receiving aperture and the clip receiving channel on each lateral side of the housing.

6. The razor cartridge of claim 1, wherein the blades are fixed blades.

7. The razor cartridge of claim 1, wherein the open area extends between the clip-receiving aperture and the clip-receiving channel on each side of the housing.

8. The razor cartridge of claim 1 further comprising a cap extending along one edge of the housing and a guard extending along the opposite long edge, wherein the clip-receiving apertures are disposed adjacent to ends of the guard and the clip receiving channels are disposed adjacent to ends of the cap.

9. The razor cartridge of claim 8 wherein a flat upper portion of each clip extends beyond the blade closest to the cap a distance substantially equal to the width of the cap, said flat upper portion being supported by an underlying portion of the housing.

10. The razor cartridge of claim 8, wherein the housing further comprises a guard bar and an edge of the clip-receiving aperture about which the clip is bent is substantially collinear with the long axis of the guard bar.

11. A shaving system comprising:

a handle, and a razor cartridge mounted on a distal end of the handle, the razor cartridge comprising an elongated housing defining a central open area, and, adjacent each short edge of the housing, a clip-receiving aperture and a clip-receiving channel, a plurality of blades disposed within the open area of the housing, and a pair of clips, each clip having a first leg and a second leg, the first leg extending through the clip-receiving aperture and being bent against a lower surface of the housing, and the second leg wrapped around a channel support member of the housing and seated in the clip-receiving channel, wherein the plurality of blades are supported by positioning elements arranged on both lateral sides of the housing and configured to secure positioning of the blades, wherein a profile of the channel support member is formed in a C-shape to define an opening at a lower side of the housing, the opening corresponding to an open side of the C-shape, wherein the opening is spanned by a portion of the second leg to define an elongated empty space within the opening which extends upward along a height of the channel support member, wherein the channel support member comprises a first surface and a second surface angled with respect to the first surface at the clip receiving channel, wherein the second surface is adjacent to a lower corner of the channel support member which is adjacent to the opening such that the second leg is bent around the first surface, the second surface, and the lower corner in a double-bend configuration adjacent to the opening.

12. A method of manufacturing a razor cartridge comprising:

providing a housing having a central open area, a clip-receiving aperture and a clip-receiving channel;

positioning a plurality of blades within the central open area; and retaining the blades within the central open area by mounting a pair of clips on the housing, each clip having a first leg and a second leg, wherein mounting comprises (a) inserting the first leg through the clip-receiving aperture, bending the first leg against a lower surface of the housing, and (b) wrapping the second leg around a channel support member of the housing such that the second leg is seated in the clip receiving channel and bending the second leg against a lower surface of the housing, wherein the plurality of blades are supported by positioning elements arranged on both lateral sides of the housing and configured to secure positioning of the blades, wherein a profile of the channel support member is formed in a C-shape to define an opening at a lower side of the housing, the opening corresponding to an open side of the C-shape, wherein the opening is spanned by a portion of the second leg to define an elongated empty space within the opening which extends upward along a height of the channel support member, wherein the channel support member comprises a first surface and a second surface angled with respect to the first surface at the clip receiving channel, wherein the second surface is adjacent to a lower corner of the channel support member which is adjacent to the opening such that the second leg is bent around the first surface, the second surface, and the lower corner in a double-bend configuration adjacent to the opening.

13. The method of claim 12 wherein the housing includes a cap and a guard, and the clip-receiving apertures are adjacent the guard and the clip-receiving channels are adjacent the cap.

* * * * *